United States Patent [19]

Kohner et al.

[11] 4,332,096

[45] Jun. 1, 1982

[54] GRAVITY FLOW DISPLAY DEVICE

[75] Inventors: Michael Kohner, Parsippany; Frank Kohner, Englewood, both of N.J.

[73] Assignee: The Michael Kohner Corp., Parsippany, N.J.

[21] Appl. No.: 268,892

[22] Filed: Jun. 1, 1981

[51] Int. Cl.[3] ..... G09F 19/00

[52] U.S. Cl. ..... 40/486; 40/409; 368/93

[58] Field of Search ..... 40/1, 409, 486, 406; 362/95, 93, 94

[56] References Cited

U.S. PATENT DOCUMENTS

| | | | |
|---|---|---|---|
| 1,002,227 | 9/1911 | Corson | 368/95 |
| 1,379,642 | 5/1921 | Meeks | 40/486 |
| 2,745,198 | 5/1956 | Nelson | 40/334 |
| 3,438,197 | 4/1969 | Roer | 368/93 |
| 3,465,516 | 9/1969 | Von Meyer | 368/95 |
| 3,692,382 | 9/1972 | Cloutier | 40/409 |
| 3,935,702 | 2/1976 | Tamada | 369/93 |

FOREIGN PATENT DOCUMENTS

| | | | |
|---|---|---|---|
| 648345 | 8/1928 | France | 40/409 |
| 65042 | 7/1942 | Norway | 40/409 |

*Primary Examiner*—Gene Mancene

*Assistant Examiner*—Wenceslao J. Contreras

*Attorney, Agent, or Firm*—Kirschstein, Kirschstein, Ottinger & Cobrin

[57] ABSTRACT

A gravity flow display device which is usable for selectively and alternatingly exhibiting two different but conceptually related displays. The device has two thin transparent walled half-hourglass compartments through which displays at their rears are visible. The device further contains non-transparent particulate matter which is capable of flowing from compartment to compartment in response to gravitational force and which is of a sufficient quantity to almost completely fill only whichever of said compartments contains it. When said non-transparent particulate matter is contained within one of the two transparent compartments, the display attached to said compartment is blocked from view.

By alternatingly reversing the comparative position of the two compartments a user can cause the particulate matter to flow from the upper compartment to the lower compartment and thus block from view the display at the rear of said lower compartment while causing the display at the rear of said upper compartment to become visible through said latter compartment.

15 Claims, 6 Drawing Figures

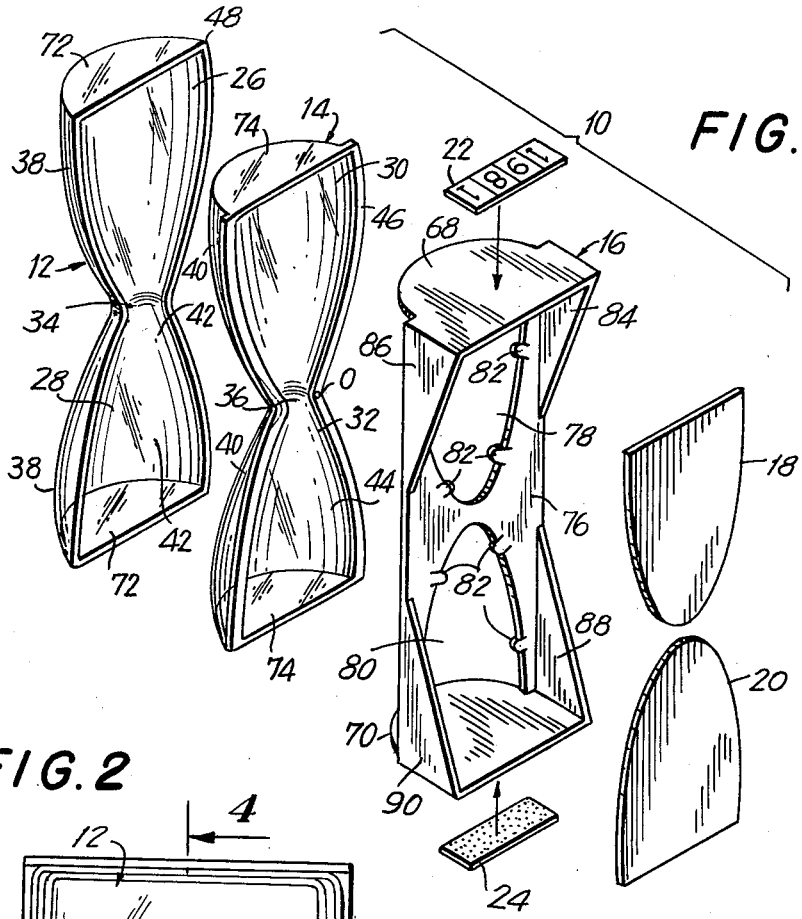
FIG. 1
FIG. 2
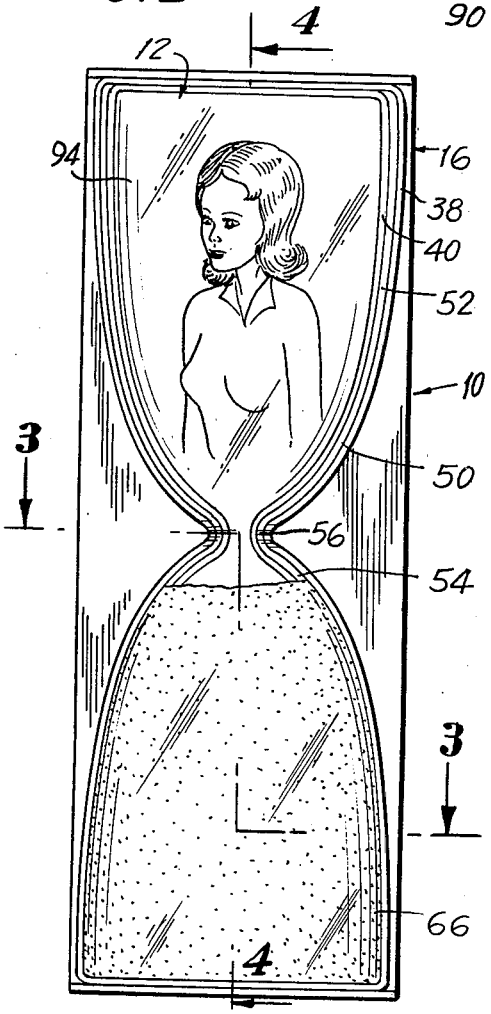
FIG. 3
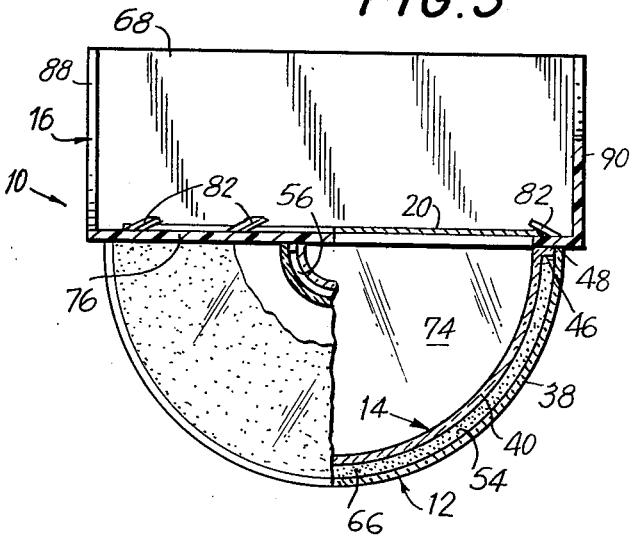

FIG. 4
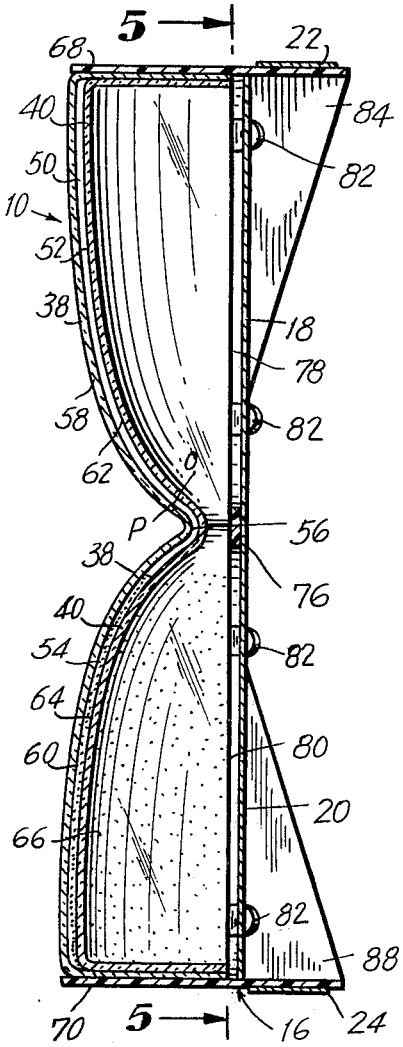
FIG. 5
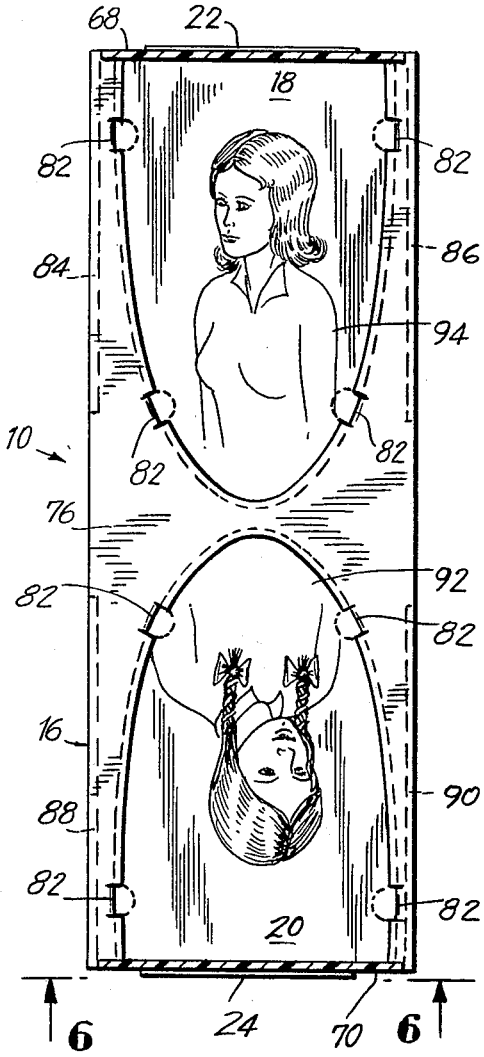
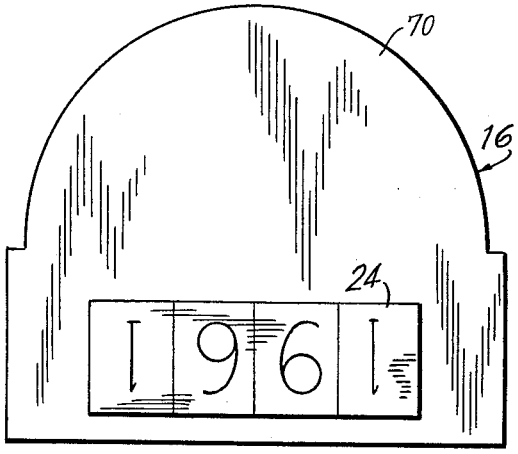
FIG. 6

GRAVITY FLOW DISPLAY DEVICE

BACKGROUND OF THE INVENTION

1. Field of the Invention

A gravity flow display device for exhibiting two related displays such that one display is visible while the other is blocked from view and vice versa.

2. Description of the Prior Art

Devices to display photographs and other items are known in the art. Two or more such items which are related to one another are often displayed in a frame with multiple display portions, however in this type of display arrangement all of the related items are concomitantly visible to a viewer.

Also known in the art are timers consisting of two transparent hourglass compartments connected by a constricted passageway. The timers contain therein sand or other non-transparent particulate matter which can alternatingly flow from one hourglass compartment to the other in response to gravitational force.

British Pat. No. 712,805 discloses two hourglass compartments connected by a constricted passageway, one of said two compartments being substantially full of sand. The two hourglass compartments form a part of a parking meter. Each compartment contains therein a sign reading "violation," said sign being blocked when the compartment it is within is in its lower filled position or when in its upper position with enough sand in it. The hourglass parking meter contains a substantial amount of sand and hence it takes a significant period of time for a lower position compartment to fill up and render the sign therein non-visible.

Other relevant patents are U.S. Pat. Nos. 679,701; 1,002,227; 1,627,270; 3,438,197; 3,692,382.

SUMMARY OF THE INVENTION

Objects of the Invention

It is an object of the present invention to provide an improved display device.

A further object is to provide a display device which avoids the various drawbacks of prior art display devices.

Another object is to provide a display device which utilizes gravitational force.

Still a further object is to provide a display device which is capable of showing two displays such that one display is visible while the other display is blocked and vice versa.

Yet another object is to provide a display device wherein the alternate blocking and unblocking from view of a display occurs in a relatively short period of time.

Another object is to provide a display device which is capable of emphasizing a time relationship between two displays.

An additional object is to provide a display device which allows quick and easy changes of the displays therein.

Another object is to provide a display device which is aesthetically pleasing.

Yet another object is to provide a display device which is inexpensive to manufacture.

Other objects of the present invention in part will be obvious and in part will be pointed out hereinafter.

BRIEF DESCRIPTION OF THE INVENTION

In keeping with these objects and others which will become apparent hereinafter, one feature of the invention resides, briefly stated, in a gravity flow display device for showing two displays such that one display is visible while the other display is blocked from view and vice versa.

The gravity flow display device includes a first and second transparent hourglass-shaped portion, each transparent hourglass-shaped portion having a generally curved face and different substantially open face. Each hourglass-shaped portion comprises two half-hourglass segments connected to one another by a constricted waist.

The display device further includes a means for attaching said first and said second portions such that the first portion nestingly fits into the second portion with the front of the curved face of the second portion being positioned behind and being spaced a small distance away from the back of the curved face of the first portion thereby creating a uniform open space between the two attached portions.

When the first and second hourglass portions are attached to one another they together comprise two thin half-hourglass-shaped compartments connected to one another by a constructed open passageway. Each of the two thin compartments curves inwardly toward said constricted open passageway and each of said thin compartments has a front face and a back face.

The display additionally contains sand or some other non-transparent fluid or fluent particulate means therein which is capable of reversibly flowing from one thin hourglass compartment to the other through the constricted open passageway in response to gravitational force. A sufficient quantity of such means is included to almost completely fill whichever of said two compartments it is contained within.

Means for detachably attaching different displays to the device is included. Each different display is capable of being attached to and in back of a different one of said two hourglass portions proximate the rear face of each.

The gravity flow display device provides a method of showing two different displays such that one display is made visible through one of the transparent hourglass compartments while the other display is blocked from view by the flowable non-transparent means and vice versa. This alternate blocking and unblocking of the different displays from view is achieved by the alternate flowing and emptying of the non-transparent flowable means into and out of the two hourglass compartments.

In this manner, it is possible to conveniently display two different, but preferably related, display items such that both display items are not concomitantly visible to a viewer. The thin hourglass-shaped compartments are constructed such that they are capable of being filled by a relatively small amount of the flowable means, thereby permitting the alternate blocking and unblocking from view of the display items to occur within a short period of time.

The novel features which are considered as characteristic of the invention are set forth in particular in the appended claim. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view of an exploded gravity flow display device of the present invention;

FIG. 2 is a front view of an assembled gravity flow display device of the present invention;

FIG. 3 is a sectional view taken substantially along line 3—3 of FIG. 2;

FIG. 4 is a sectional view taken substantially along line 4—4 of FIG. 2;

FIG. 5 is a sectional view taken substantially along line 5—5 of FIG. 4; and FIG. 6 is a bottom view taken substantially along line 6—6 of FIG. 5.

DETAILED DESCRIPTION OF THE PREFERRED EMBODIMENTS

Referring now to the drawings, the reference numeral 10 denotes the gravity flow display device of the present invention exploded, which is characterized by the provision of a front transparent hourglass-shaped portion 12, a rear transparent hourglass-shaped portion 14, a support-frame portion 16, two display supporting portions 18, 20 and two indicia portions 22, 24.

The two hourglass-shaped portions 12, 14 may be constituted of any appropriate material, but in keeping with the present invention both hourglass-shaped portions must be transparent.

The front hourglass-shaped portion 12 is substantially similar in shape to and slightly larger than the rear hourglass-shaped portion 12. Their vertical walls are similar. Each of portions 12 and portion 14 is comprised of two half-hourglass segments 26, 28, 30, and 32 respectively. Segments 26 and 28 are connected to one another by a constricted waist 34 and segments 30 and 32 are connected to one another by a different constricted waist 36. Portions 12 and 14 both have a generally curved front face 38, 40 and a substantially open rear face 42, 44.

Portions 12 and 14 are attachable to one another with rear portion 14 nestingly fitting into and in back of front portion 12. In the illustrated embodiment, rear portion 14 is formed with vertical side edge flanges 46 and front portion 12 includes narrow peripheral side edges 48, flange 46 and edge 48 being shaped and dimensioned to cooperate with one another for attaching portions 12 and 14 together with the aid of adhesive or autogeneous welding.

Portions 12 and 14 are attached and are so structured and dimensioned that the open rear face 42 of the front portion 12 is positioned in front of and spaced a short distance away from the front face 40 of the rear portion 14 thereby providing a substantially uniform thin space 50 between and for the full heights of portions 12 and 14. As an example, the front-to-back dimension of this space is about $\frac{1}{4}''$.

When portions 12 and 14 are so attached, as best shown in FIGS. 2 and 4, they form two thin half-hourglass-shaped compartments 52, 54 connected to one another by a constricted open passageway 56. Constricted open passageway 56 is formed from the two waists 34 and 46. Compartments 52 and 54 are both formed to taper inwardly toward constricted open passageway 56 and each compartment has a front face 58, 60 and a rear face 62, 64 (see FIG. 4).

The thin space contains non-transparent flowable means which in a preferred embodiment is sand 66, either monochromatic or variegated. The sand 66 is capable of flowing from whichever half-hourglass compartment is positioned uppermost to whichever half-hourglass compartment is positioned lowermost in response to the force of gravity. The sand 66 flows reversibly from compartment 52 or 54 to compartment 54 or 52 through constricted open passageway 56. A sufficient quantity of sand is included to almost completely fill whichever of said two compartments is lowermost. The sand can be introduced into the space 50 through an opening 0 near the waist of the device which then is plugged as with putty P. If a fluid is used, it should be sufficiently viscous to flow slowly from one compartment to the other in the alloted period of time, e.g. 10–15 seconds. A suitable fluid is silicone oil containing an opaque coloring agent, e.g. titanium dioxide.

Support-frame portion 16 is secured to the attached hourglass-shaped portions 12 and 14. Support-frame portion has different lower horizontal flat panels 68 and 70 dimensioned and shaped to fit over the flat ends 72 and 74 of hourglass portions 12 and 14.

Support-frame portion 16 is formed with a vertical generally planar wall 76 having two arch-shaped cut-out portions 78, 80 therein. Cut-out portions 78 and 80 are shaped and dimensioned to be generally similar to the horizontally projected size and shape of half-hourglass compartments 52, 54.

A plurality of integral rearwardly displaced tabs 82 are positioned peripherally around each cut-out portion 78 and 80 approximately parallel to wall 76. The tabs 82 provide a means for detachably attaching displays to the device 10.

Additionally, support-frame portion 16 is formed with four braces 84, 86, 88, and 90 interconnecting the sides of the wall 76 with flat ends 68, 70. The four braces stabilize device 10 and are integral parts of support-frame portion 16, each brace having the general shape of a right triangle.

The two display supporting portions 18 and 20 are substantially similar in shape to and slightly larger than cut-out portions 78 and 80. They may be constituted of any appropriate material, e.g. cardboard. Instead of attaching displays directly to device 10 with the tab portions, the display may be adhered to display supporting portions 18 and 20 and then display supporting portions are attached to the device by slipping said displays and display securing portions between the tabs and the edge of planar wall 76 immediately adjacent said cut-out portions. The added thickness of the display supporting portions aids in securely attaching the displays to the device, and further the display supporting portions protect the backs of the displays from damage. The displays and display supporting portions are easily detachable from said device by sliding same out from between the tab portions and the edge of the planar wall. Optionally, the displays are merely placed on the display supporting portions without using any additional attaching means so that the displays may be easily changed when the user so desires.

A plurality of indicia portions, of which indicia portions 22 and 24 are exemplicative, are provided so that a user may identify the displays shown in the device. By way of example, as shown on indicia portion 22, the displays may be identified by their years of origin.

Displays need not be provided with device 10; the user may place therein any two different displays that he desires. The displays as exemplified by displays 92 and 94 should bear a relationship to one another. Preferably the two different displays are such that when viewed in sequence two different, but related, concepts are shown for comparison. By way of example, as shown in FIG. 5, displays 92 and 94 are photographs of the same woman at different times of her life, 92 being a picture of her as a young girl and 94 being a picture of her as a mature woman. The displays may be photographs, as shown in the drawings, or any other type of related displays such as two segments of a phrase or expression. For example, one of said two displays might read "Happy Birthday" and the other of said two displays might read "to the one I love", or one of said two displays may read "a time to weep and a time to laugh" and the other of said two displays may read "a time to mourn and a time to dance." There are an infinite number of different related displays that may be compared when shown in device 10, the photographs illustrated and expressions written above merely being examples of such related displays.

The displays 92 and 94 are sufficiently large to fill the cut-out portions 78 and 80, but are small enough so as not extend beyond the outer peripheries of device 10. Although the displays as illustrated in the drawings are two-dimensional, it is possible to display three-dimensional objects in device 10 or to have one display constitute a three-dimensional structure or figure and the other display constitute suitable correlated text. An example is for the figure to be a molded college graduate in cap and gown with the expression "Congratulations" over his head and for the text a message reading "You've finally made it!"

The thin half-hourglass-shaped compartments 52 and 54 are dimensioned and shaped such that the amount of sand 66 contained in the device will completely fill whichever of said two compartments it is contained within. Due to the fact that the compartments 52 and 54 are transparent when the sand 66 is not contained therein, the displays attached behind the compartments in their non-filled state are visible therethrough. Further, because the sand 66 is non-transparent, when one of said two compartments 52 and 54 is filled with same, the display behind the filled compartment is visually blocked from the front by said sand and hence not visible to a viewer. By turning the device upside down such that the compartment that was uppermost becomes lowermost and the compartment that was lowermost becomes uppermost, a user can selectively make either display visible while the other display is blocked from view by the sand 66.

Device 10 thus provides a method for showing two different related displays 92, 94 such that each one of the two different related displays is capable of being visible to a user while the other different display is blocked from a user's view by the sand 66 and vice versa. To use device 10, the displays 92 and 94 are attached to the device in back of the transparent half-hourglass compartments 52 and 54. A user may then at will turn the device and thereby change the relative positions of the two compartments while concomitantly changing one of said two displays from its blocked to its visible condition and vice versa.

Due to the fact that compartments 52 and 54 are quite thin and are thus filled by only a small amount of sand 66, this afore-described alternate filling and emptying of sand 66 into and from the compartments with its resultant alternate blocking and unblocking of the two different related displays from view occurs in a short period of time in response to the force of gravity, for example 15 seconds.

The generally hourglass configuration and operation of device 10 emphasizes the temporal relationship between the two alternatingly visible different displays attached thereto in addition to providing a decorative, easy manipulatable and relatively inexpensive structure with which to exhibit said two related different displays.

It will be understood that each of the elements described above, or two or more together, may also find a useful application in other types of constructions differing from the types described above.

While the invention has been illustrated and described as embodied in a gravity flow display device for exhibiting two related displays wherein one display is visible while the other is blocked from view and vice versa, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A gravity flow display device comprising:

(A) a first transparent front hourglass-shaped portion with a forwardly convex front face that tapers widthwise to a first constricted waist and with a matching concave rear face, the portion thereby comprising two half-hourglass segments connected to one another by said first constricted waist;

(B) a second transparent rear hourglass-shaped portion substantially similar in shape to and slightly smaller than said front hourglass-shaped portion, said second portion also comprising two different half-hourglass segments connected to one another by a second constricted waist;

(C) means for attaching said first and said second portions such that said second portion nestingly fits into the rear of said first portion such that the front of the rear face of said second portion is positioned behind and spaced a small distance away from the front face of said first portion to create a thin space between said two attached portions;

(D) means to clip the top and bottom of said thin space;

(E) said first and said second hourglass portions when attached comprising two thin half-hourglass-shaped compartments connected by a constricted open passageway, each of said two compartments being configured to taper inwardly width-wise toward the constricted open passageway and each of said two compartments having a front face and a rear face;

(F) non-transparent flowable means in said space being capable of reversibly flowing from one thin half-hourglass compartment to the other thin half-hourglass compartment through the constricted open passageway in response to gravitational force, said flowable means being of a quantity sufficient only to almost completely fill whichever of said two compartments it is contained within;

(G) means for detachably attaching different displays, each different display being attachable adjacent to and in back of a different one of said two hourglass portions proximate the rear face of each; and (H) whereby each attached display is made visible through one of said transparent hourglass compartments while the other attached display is visually blocked by said non-transparent means and vice versa by the alternate filling and emptying of said flowable means into and from said hourglass compartments.

2. A gravity flow display device comprising:

(A) a first transparent front hourglass-shaped portion with a forwardly convex front face that tapers width-wise to a first constricted waist and with a matching concave rear face, the portion thereby comprising two half-hourglass segments connected to one another by said first constricted waist;

(B) a second transparent rear hourglass-shaped portion substantially similar in shape to and slightly smaller than said front hourglass-shaped portion, said second portion also comprising two different half-hourglass segments connected to one another by a second constricted waist;

(C) means for attaching said first and said second portions such that said second portion nestingly fits into the rear of said first portion such that the front of the rear face of said second portion is positioned behind and spaced a small distance away from the front face of said first portion to create a thin space between said two attached portions;

(D) means to clip the top and bottom of said thin space;

(E) said first and said second hourglass portions when attached comprising two thin half-hourglass-shaped compartments connected by a constricted open passageway, each of said two compartments being configured to taper inwardly width-wise toward the constricted open passageway and each of said two compartments having a front face and rear face;

(F) non-transparent flowable means in said space being capable of reversibly flowing from one thin half-hourglass compartment to the other thin half-hourglass compartment through the constricted open passageway in response to gravitational force, said flowable means being of a quantity sufficient only to almost completely fill whichever of said two compartments it is contained within;

(G) means for detachably attaching two different displays, said two different displays being related to one another such as to provide a comparison of concepts, each different display being attachable adjacent to and in back of a different one of said two hourglass portions proximate the rear face of each; and (H) whereby a user may selectively and alternatingly cause each of said two different related displays to be either visible through a transparent portion or blocked from view by said non-transparent means and thus emphasize the conceptual comparison between said two different displays.

3. The gravity flow display device of claim 2, and additionally comprising a frame means securable to said attached first and second transparent hourglass-shaped portions.

4. The gravity flow display device of claim 3, wherein the means for detachably attaching different displays is operatively connected to said frame means.

5. The gravity flow display device of claim 3, wherein the frame means contains two flat ends, and a generally planar inner wall with two generally arch-shaped cut-outs therein, each generally arch-shaped cut-out shaped and dimensioned to cooperate with a different one of said two hourglass-shaped compartments.

6. The gravity flow display device of claim 5, and additionally comprising indicia means capable of being detachably attached to said frame means in association with the different displays.

7. The gravity flow display device of claim 5, wherein said means for detachably attaching different displays is a plurality of tabs disposed peripherally around each generally arch-shaped cut-out.

8. The gravity flow display device of claim 3, and additionally comprising support portions operatively connected to said frame means.

9. The gravity flow display device of claim 2, and additionally comprising two display supporting means for detachably retaining different displays adjacent to and in back of different ones of said hourglass portions.

10. The gravity flow display device of claim 9, and additionally comprising a frame means with arch-shaped cut-outs wherein the supporting means are of a substantially similar shape and slightly larger than the arch-shaped cut-outs.

11. The gravity flow display device of claim 2, in which the two different displays are photographs of the same person at different ages.

12. The gravity flow display device of claim 2, wherein each different display is a portion of an expression or a phrase.

13. The gravity flow display device of claim 2, in which the non-transparent flowable means is sand.

14. The gravity flow display device of claim 2, wherein one of said transparent hourglass-shaped portions has a peripheral flange thereon, and wherein the other transparent hourglass-shaped portion has a narrow peripheral edge wall, the wall and the flange shaped and dimensioned to securely abut against one another.

15. A method for showing two different displays such that each one of said displays is capable of being made visible while the other display is blocked from view and vice versa, using the display device of claim 2, the method comprising the steps of:

(A) providing two different displays;

(B) attaching said two different displays to the device such that each different display is adjacent to and in back of a different one of said two hourglass portions;

(C) turning the device such that the hourglass portion which was uppermost is lowermost and the hourglass portion which was lowermost is uppermost;

(D) letting the flowable means flow from the uppermost portion to the lowermost portion thereby making the display attached adjacent to uppermost portion visible and the display attached adjacent the lowermost portion blocked from view; and (E) selectively repeating steps C and D, whereby a user can selectively and alternatingly make one display visible while the other display is blocked from view.

* * * * *